US007533541B1

(12) United States Patent
Zakinov

(10) Patent No.: US 7,533,541 B1
(45) Date of Patent: May 19, 2009

(54) JEWELRY SETTING FOR A ROW OF DIAMONDS

(75) Inventor: Rafael Zakinov, Kew Gardens, NY (US)

(73) Assignee: Signed Pieces, New York, NY (US)

( * ) Notice: Subject to any disclaimer, the term of this patent is extended or adjusted under 35 U.S.C. 154(b) by 0 days.

(21) Appl. No.: 11/198,966

(22) Filed: Aug. 8, 2005

(51) Int. Cl.
*A44C 17/02* (2006.01)

(52) U.S. Cl. ..... 63/28; D11/34

(58) Field of Classification Search ..... 63/28; D11/34, 26, 90, 91
See application file for complete search history.

(56) References Cited

U.S. PATENT DOCUMENTS

| | | | | | |
|---|---|---|---|---|---|
| 1,146,543 | A | * | 7/1915 | Abel | 63/15 |
| 2,117,736 | A | * | 5/1938 | Link | 63/27 |
| 2,136,818 | A | * | 11/1938 | Kestenman | 59/80 |
| 2,538,090 | A | * | 1/1951 | Ferragamo | 63/4 |
| 2,584,207 | A | * | 2/1952 | Holl | 63/27 |
| 5,339,655 | A | * | 8/1994 | Grando | 63/9 |
| 5,694,791 | A | * | 12/1997 | Esposito | 63/3 |
| D447,716 | S | * | 9/2001 | Itzknowitz | D11/26 |
| D512,658 | S | * | 12/2005 | Aghjayan et al. | D11/34 |
| D513,712 | S | * | 1/2006 | Koren | D11/34 |
| D520,397 | S | * | 5/2006 | Rives | D11/34 |

OTHER PUBLICATIONS

Rio Grande Gems and Findings Catalong (Aug. 2001-Aug. 2002, p. 127.*

* cited by examiner

*Primary Examiner*—Victor Batson
*Assistant Examiner*—David C Reese
(74) *Attorney, Agent, or Firm*—Levisohn Berger LLP

(57) ABSTRACT

A novel setting for holding diamonds in a row in a ring such as an Eternity wedding band, said novel setting having an X structure with apertures formed in the bottom of the setting bridging between the culets of the diamonds with solid structure between the apertures located below each culet. The cross over point of the X structure has a recess to help hold the diamonds in place. Side walls adjacent the diamonds are materially lower than in the prior art and expose significantly more of the diamonds held in the setting.

3 Claims, 5 Drawing Sheets

JEWELRY SETTING FOR A ROW OF DIAMONDS

BACKGROUND OF THE INVENTION

This invention relates to a new jewelry setting, and, in particular, to a jewelry setting for securing a row of precious stones, such as diamonds, in place.

Diamond jewelry has long been popular, widely sold and very attractive. One of the important objectives of diamond jewelry is to maximize brilliance when the diamonds are set to enhance their visual appearance and value.

The prior art is replete with diamond jewelry, especially wedding bands and engagement rings, and the settings to hold diamonds in place are widely varied. In essence, the primary objective which needs to be met is that the stone(s) be securely held in place while allowing as much light to pass therethrough and enhance the visual effect achieved thereby.

Individual diamonds are held by prongs as solitaires or in a bezel set, that is, single stones are held in a plurality of different ways. This invention relates to a new setting for holding a plurality of diamonds or stones in a row.

Conventional settings for diamonds set in a row has each diamond set in a respective set of prongs per stone. Some prior art teaches shared prongs, in which a prong holds two adjacent stones, so that the number of prongs is reduced and the precious metal utilized is also lessened. By reducing the amount of prong material which bears on the top of the stone, more light is permitted to pass therethrough, and a generally lighter, more modern look and feel is achieved.

In prior art shared prong settings, the culet of the diamond generally sits in a round hole formed in the bottom of the setting permitting some light to pass from under the stone. Since the stone rests in the hole at its bottom, side walls are required to provide sufficient structural strength for the ring to both support and secure the stones and the prongs. In the prior art, such side walls rise to at least half the height of the stone. These side walls block light passing through the set diamond which is undesirable.

An object of this invention is to provide a setting for a row of diamonds in which a shared prong is utilized but the amount of light passing through the diamonds is greater than that of the prior art.

Another object of this invention is to provide such a setting which is visually attractive.

Still another object of this invention is to provide such a setting in which the amount of precious metal required is less than that of prior art settings.

Still another object of this invention is to provide such a setting which is adaptable to open or channel type stone settings.

Yet another object of this invention is to provide such a setting which can be utilized for earrings, pendants, bracelets as well as for rings and wedding bands.

In accordance with this invention, the above objects are accomplished by providing an open setting for a row of diamonds in which the metallic support surface under the diamonds has a general X pattern having repetitive cross over points separated by repetitive quadrangle openings defining adjacent apexes. The shared prongs for holding the stones are located and extend upwardly from the apexes and have heights suitable to bear on the diamonds held thereby.

The culet of the stones/diamonds are held at the cross-over points and is held in a slight recess or divot formed thereat. In this way, the culets firmly sit in place and the diamonds are securely held on top by the shared prongs. By providing a bottom and solid support under the culet of the diamond, the side walls of the setting can be less high than that found in the prior art. The side walls of the settings of the prior art allow generally less than half of the side of the diamond to be revealed or uncovered, whereas the side walls of the setting of this invention reveal significantly more of the sides of the stones, and therefore a more brilliant look is achieved without sacrificing security.

DETAILED DESCRIPTION OF THE PREFERRED EMBODIMENT

Figure 1:
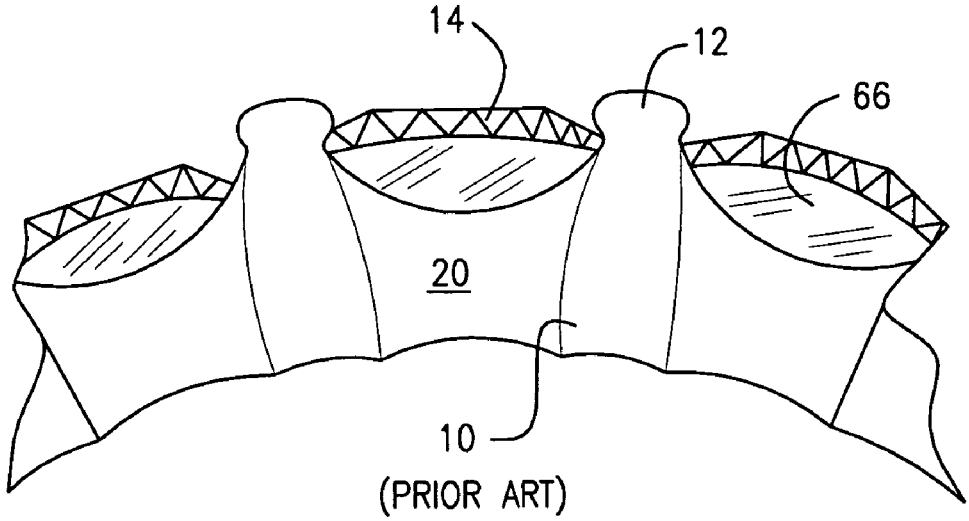
(PRIOR ART) FIG. 1
FIG. 1 is a side view of three diamonds set in a row in a prior art setting.
Figure 2:
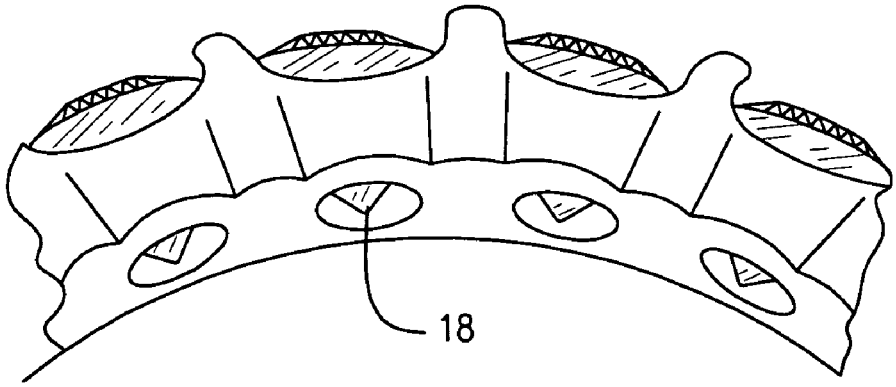
(PRIOR ART) FIG. 2
FIG. 2 is a bottom perspective view of the setting of FIG. 1.

FIGS. 1 and 2 illustrate the prior art shared-prong setting in which the setting 10 has a plurality of shared prongs 12 which hold adjacent stones 14 and 16. The setting structure has apertures 18 for holding the culet of each respective stone, such as stone 14. The aperture allows light to pass therethrough. This is the standard prior art shared-prong mounting or setting generally utilized in the industry. Because the bottom aperture 18 is directly below and encircles the culet, the structural support to hold the stone in place is substantially derived from the prongs as well as the side walls 20 on both sides of each respective diamond. Because it is very important that the stones be securely set, the prior art side walls 20 adjacent each of the stones generally extend up and cover a large portion of the side of the stone. As can be seen in FIG. 1, almost 70% of the height of the stone (from culet to table) is covered by side wall 20. This significantly blocks light from passing through the sides of the diamond and does not enhance its brilliance. The general relationship of the height of the sides 20 versus the height of the stones 14 is standard in the prior art.

Figure 3:
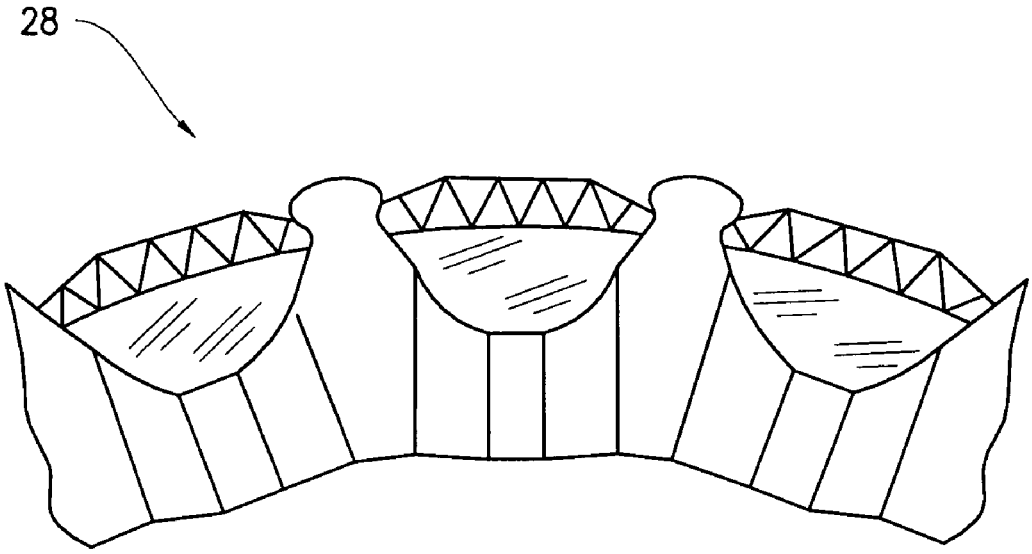
FIG. 3 is a side view of the setting invention illustrating the lower wall of the setting and thus more exposure of the sides of the diamonds to reflect light and brilliance.
Figure 4:
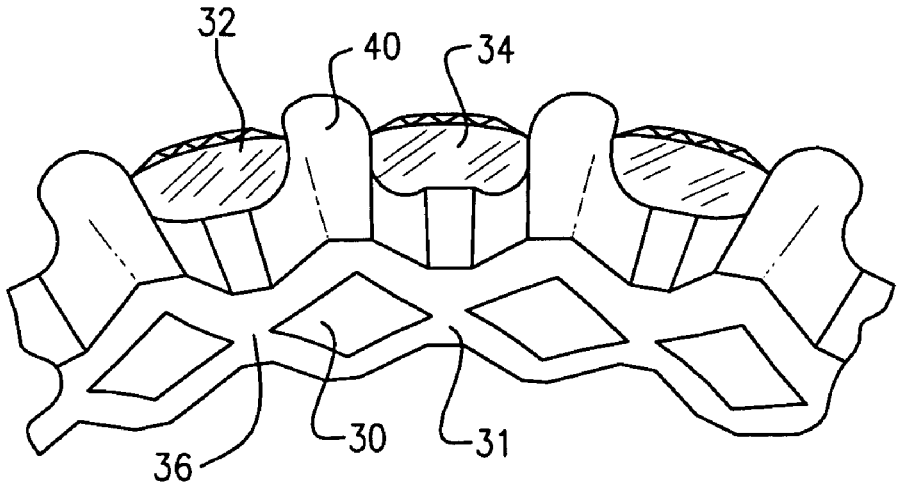
FIG. 4 is a bottom perspective view of the setting of FIG. 3.

Referring to FIGS. 3 and 4, the instant invention is illustrated with drawings which correspond to the prior art drawings of FIGS. 1 and 2. In particular, FIG. 3 is a side perspective view illustrating the setting 28 of the present invention, while FIG. 4 is a bottom perspective view. The primary difference between the prior art and the present invention is that the holes or apertures 30 located in the bottom surface of the setting are formed by a cross over or X structure 31. This X or cross over structure 31 forms diamond shaped or square shaped apertures 30 in the bottom surface of the setting, and the aperture 30 is offset from the culet and basically spans respective sets of adjacent stones 32 and 34. Stated another way, the culets of the stones are located, preferably, in a small divot (see 50 of FIG. 5) on the top side of the X-shapes or cross over points while the apertures extend upwardly through the metal to allow light to come from below to be reflected. The arms of the "X" of the setting terminate at apexes 40 which form the base for the upwardly extending (and then over lapping the stone) prongs. As can be seen in the side view of FIG. 3, the side walls of the setting of this invention allow at least 60% of the side of the stone to be visible, which is a material improvement over the prior art. The reason more of the stone can be seen from the side is that the ring structure beneath the culet is solid as shown at the cross over point 36 of the X structure 31, and the amount of structural side wall support required to maintain the structural integrity of the ring is thereby decreased. This contrasts with the prior art in which the structure beneath the culet is drilled through the setting so that there is no structural support directly under the diamond held in the setting.

As may be readily apparent, by exposing much more of the side of each stone than is available with the prior art, greater brilliance and "fire" is achieved for stones set with the setting of this invention. The larger the stones the greater the improvement because the larger the stones, the greater the ratio of the size of the bottom aperture 30 in relation to the size of the stones. The combination of light reflected from the bottom of the stones in conjunction with the reduced side wall blockage compared with the setting of the prior art enables this invention to provide an improved visual appearance for diamonds set with the setting of this invention.

Figure 5:
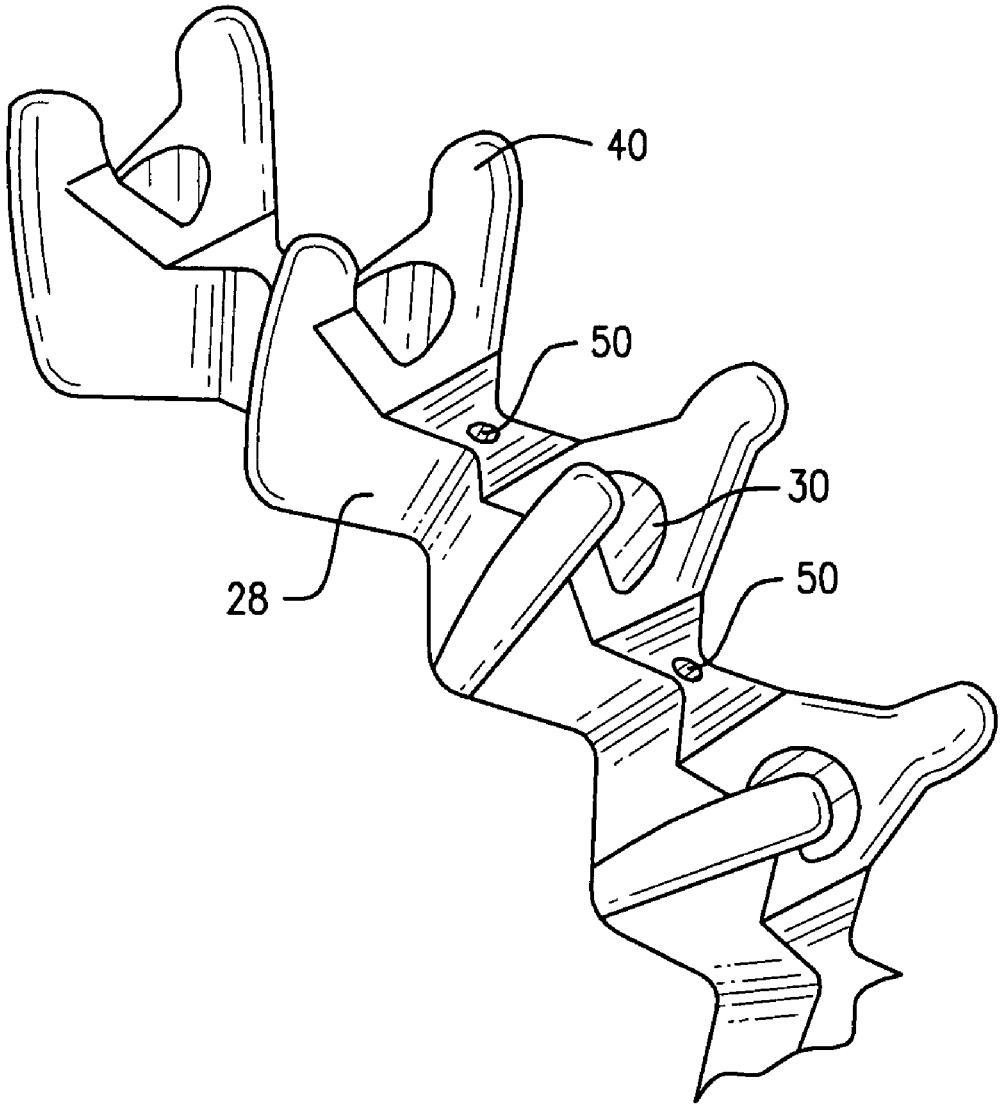
FIG. 5 is a top perspective view of a portion of the setting of this invention.

FIG. 5 is a top perspective view of the setting 28 of this invention in which a slight recess or divot 50 is provided at the cross-over point under the culet in order to further locate and hold the culet and stone in place when the shared-prongs are bent to secure the stone in place.

Figure 6:
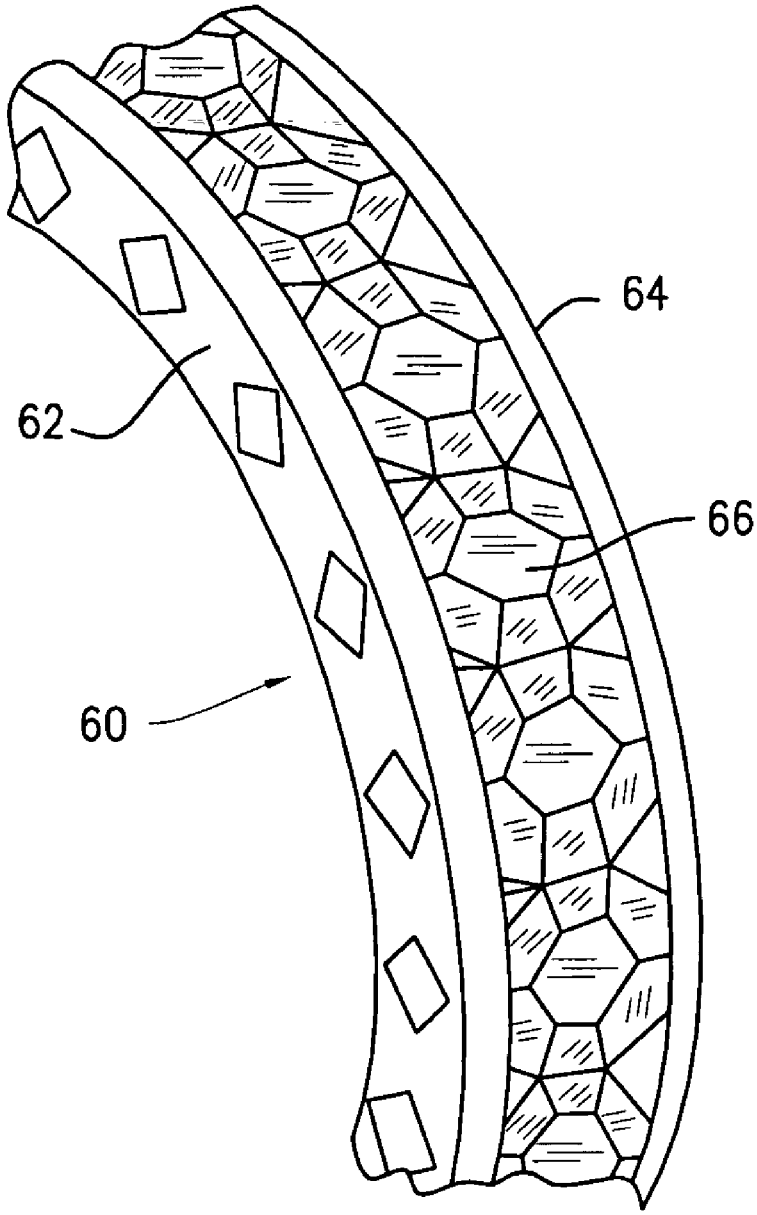
FIG. 6 is a perspective view of an embodiment of this invention for a channel setting.
Figure 7:
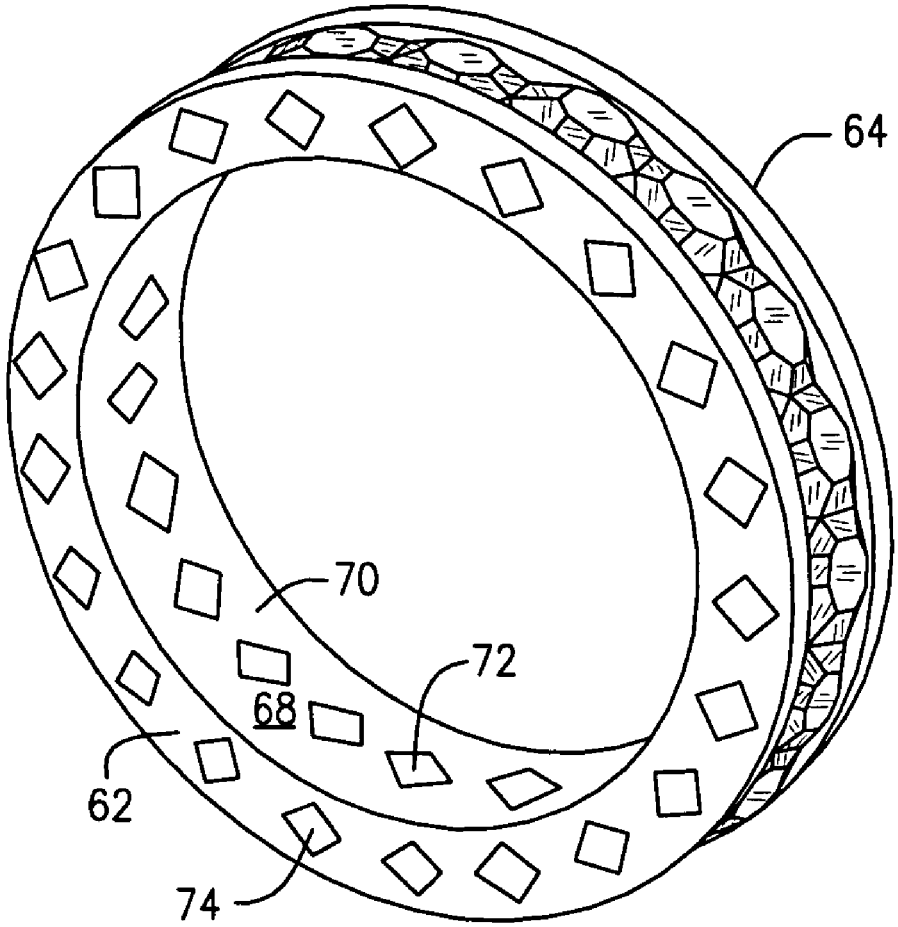
FIG. 7 is a side perspective view of the channel setting of FIG. 6.

FIG. 6 is another embodiment of this invention in which a channel setting 60 is provided, the channel being formed of opposite side walls 62 and 64 extending above the top of the diamond 66 with an annular groove (not shown) formed toward the top of each side wall in which the side edge of the girdle of the diamond is held. Channel settings are well known prior art. In accordance with the principles of this invention, the setting below the culet is solid because it is formed at the cross-over point 68 of the X structure 70 for the setting on which the diamonds rest. Apertures 72 are formed between the X structure of the setting, i.e., between each of the culets, and additionally apertures 74 are formed in the side walls 62 and 64 to permit additional light to pass through the diamonds. By locating the culets at the cross-over points, there is bottom structural support for the stones in the setting so that light permitting side apertures 74 can be formed without lessening the structural integrity of the setting.

The embodiments shown illustrate the settings at only a portion of the ring structure, but as understood such setting can comprise the entire ring as in eternity rings in which the diamonds completely encircle the wearer's ring. Setting a row of stones in accordance with this invention can also be employed in other jewelry such as pendents and earrings.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. In combination, a mounting for setting diamonds in a row, said mounting and diamonds forming a jewelry item, each of said diamonds comprising a culet at its bottom and said mounting comprising a divot in which said culet rests, said mounting comprising a single piece structure having prongs spaced apart along the dimension of said row, said prongs formed as two rows of prongs located on opposite sides of said stones, each of said successive prongs separated from each other by metal supporting said diamonds, said metal between said prongs forming a valley to reveal the sides of said diamonds, each of said prongs in said two rows of prongs located opposite to each other and holding two successive precious stones, said divot located in said mounting between pairs of successive prongs in said two rows of prongs to receive and support the culet of a diamond set between and by said opposite prongs, spaced apart apertures formed in the bottom of said mounting along the dimension of said row, with individual ones of said apertures located between opposite prongs in said rows of prongs, said apertures aligned with said opposite prongs and located between successive stones, each of said diamonds being supported and held in place in said divot and by said prongs, whereby a substantial portion of the sides of said diamonds is visible.

2. The combination as in claim 1, wherein said mounting comprises a repetitive X shaped structure at the bottom thereof with the cross-over of said X shaped structure being below said divot which holds said diamonds, such X shaped structure forming said spaced apart apertures, said X shaped structure extending the length of said mounting.

3. The combination as in claim 1 or 2, wherein said mounting structure comprises opposite apexes spaced apart along said setting, said shared-prong formed at said opposite apexes, said spaced-apart apertures comprising diamond shapes with the center of said apertures being located between said opposite apexes.

* * * * *